US009691573B2

(12) United States Patent
Dhote et al.

(10) Patent No.: US 9,691,573 B2
(45) Date of Patent: Jun. 27, 2017

(54) ELECTRICAL SWITCH AND SLIDER ASSEMBLY THEREFOR

(71) Applicant: EATON CORPORATION, Cleveland, OH (US)

(72) Inventors: Navneet Ramkrushnaji Dhote, Maharashtra State (IN); Nitin Rawal, Maharashtra State (IN); Oscar L. Neundorfer, Senoia, GA (US); Pramod Kumar, Peachtree City, GA (US)

(73) Assignee: EATON CORPORATION, Cleveland, OH (US)

( * ) Notice: Subject to any disclaimer, the term of this patent is extended or adjusted under 35 U.S.C. 154(b) by 81 days.

(21) Appl. No.: 14/585,395

(22) Filed: Dec. 30, 2014

(65) Prior Publication Data

US 2016/0189893 A1 Jun. 30, 2016

(51) Int. Cl.
*H01H 15/10* (2006.01)
*H01H 23/14* (2006.01)

(52) U.S. Cl.
CPC ..... *H01H 23/145* (2013.01); *H01H 15/10* (2013.01)

(58) Field of Classification Search
CPC ..... H01H 15/00; H01H 15/02; H01H 15/06; H01H 15/10; H01H 15/16; H01H 2221/014; H01H 23/025; H01H 23/14; H01H 9/52; H01H 11/0018; H01H 23/145; H01H 1/12; H01H 1/36; H01H 3/00; H01H 3/02; H01H 2221/00
USPC ..... 307/154, 155, 156, 157, 139, 140, 143; 200/335, 339, 341, 547, 502, 5 R, 5 EA, 200/537, 549, 550, 16 E, 178, 51 R, 200/51.02, 531, 563, 252, 241, 536, 200/431–437
See application file for complete search history.

(56) References Cited

U.S. PATENT DOCUMENTS 4,180,712 A * 12/1979 Lutzenberger ..... H01H 15/02 200/16 D
4,190,754 A * 2/1980 Kilar ..... H01H 15/10 200/17 R
6,005,308 A * 12/1999 Bryde ..... H05B 39/00 200/335
8,853,893 B2 * 10/2014 Savicki, Jr. ..... H05B 33/0815 200/339
2009/0121661 A1 * 5/2009 Dodal ..... H01H 15/06 318/51

(Continued)

*Primary Examiner* — Anthony R. Jimenez
(74) *Attorney, Agent, or Firm* — Eckert Seamans; John Powers; Grant Coffield

(57) ABSTRACT

A slider assembly is for an electrical switch such as, for example, a dimmer switch. The dimmer switch includes a switching member and a housing member. The housing member overlays the switching member and includes an exterior surface, an interior surface, and an elongated slot. The slider assembly includes a slider structured to cooperate with the switching member. The slider includes an interface portion and an attachment portion. The attachment portion extends through the elongated slot of the housing member. The interface portion is movably disposed on the exterior surface of the housing member. A shutter is coupled to the slider. The shutter includes a plurality of resilient elements structured to engage the interior surface of the housing member, thereby creating a friction force associated with movement of the slider.

20 Claims, 6 Drawing Sheets

(56) References Cited

U.S. PATENT DOCUMENTS

2010/0225619 A1* 9/2010 Soumi ..... G06F 3/0362
345/184

* cited by examiner

ELECTRICAL SWITCH AND SLIDER ASSEMBLY THEREFOR

CROSS-REFERENCE TO RELATED APPLICATION

This application is related to commonly assigned, concurrently filed U.S. patent application Ser. No. 14/585,398, filed Dec. 30, 2014, and entitled "ELECTRICAL SWITCH AND MOUNTING ASSEMBLY THEREFOR" which is incorporated herein by reference.

BACKGROUND

Field

The disclosed concept relates generally to electrical switches and, more particularly, to electrical switches such as, for example, dimmer switches. The disclosed concept also relates to slider assemblies for dimmer switches.

Background Information

Electrical switches, such as dimmer switches, are commonly used to control the amount of power delivered to an electrical load, for example, in order to control the intensity of a lighting load, or to control the speed of a ceiling fan.

A dimmer switch is typically mounted to an electrical box disposed in a wall or other suitable structure, and is electrically connected between a power source and the electrical load. The dimmer switch generally include a faceplate coupled to the electrical box, and a user interface, such as a linear slider, which is movably disposed on the faceplate. The dimmer switch may also include a button or toggle for switching the load ON and OFF. The user interface cooperates with a potentiometer. That is, the linear slider is adjustable (i.e., movable) to correspondingly adjust (i.e., control) the current delivered to the load and thus the intensity of the light or the speed of the fan. To ensure effective operation and user satisfaction, the linear slider must have desirable operating characteristics and ergonomics.

There is room for improvement in electrical switches, such as dimmer switches, and in slider assemblies therefor.

SUMMARY

These needs and others are met by embodiments of the disclosed concept, which are directed to a slider assembly for electrical switches, which among other benefits, exhibits improved operating characteristics and ergonomics.

As one aspect of the disclosed concept, a slider assembly is provided for an electrical switch. The electrical switch includes a switching member and a housing member overlaying the switching member. The housing member comprises an exterior surface, an interior surface, and an elongated slot. The slider assembly comprises: a slider structured to cooperate with the switching member, the slider including an interface portion and an attachment portion, the attachment portion being structured to extend through the elongated slot of the housing member, the interface portion being structured to be movably disposed on the exterior surface of the housing member; and a shutter coupled to the slider, the shutter including a plurality of resilient elements structured to engage the interior surface of the housing member, thereby creating a friction force associated with movement of the slider.

The interface portion of the slider may comprise an elongated molded portion, wherein the elongated molded portion includes a plurality of ribs or serrations. The shutter may comprise a first side, a second side disposed opposite the first side, a first end, a second end disposed opposite and distal from the first end, and an elongated slot disposed between the first end and the second end and extending from the first side toward the second side. The elongated slot of the shutter may be structured to generally align with the elongated slot of the housing member.

The shutter may further comprise a first molded spring element extending outwardly from the first side and a second molded spring element extending outwardly from the first side opposite and spaced from the first molded spring element. The first molded spring element may be disposed between the first end and the elongated slot of the shutter, and the second molded spring element may be disposed between the second end and the elongated slot of the shutter. The first molded spring element and the second molded spring element may be structured to exert a bias against the interior surface of the housing member to create the friction force associated with movement of the slider.

As another aspect of the disclosed concept, an electrical switch comprises: a switching member; a housing member overlaying the switching member, the housing member comprising an exterior surface, an interior surface, and an elongated slot; and a slider assembly comprising: a slider cooperating with the switching member, the slider including an interface portion and an attachment portion, the attachment portion extending through the elongated slot of the housing member, the interface portion being movably disposed on the exterior surface of the housing member, and a shutter coupled to the slider, the shutter including a plurality of resilient elements, the resilient elements engaging the interior surface of the housing member to create a friction force associated with movement of the slider.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

Figure 1:
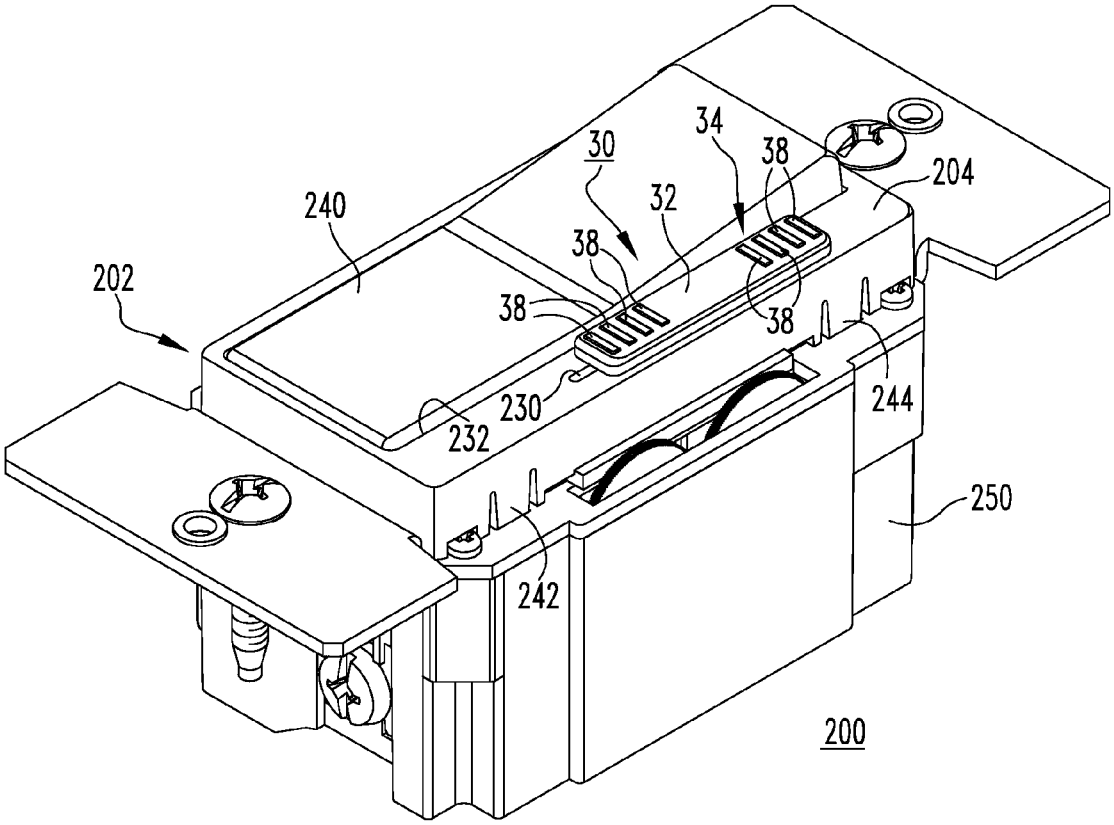
FIG. 1 is an isometric view of a dimmer switch and slider assembly therefor, in accordance with an embodiment of the disclosed concept.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, left, right, top, bottom and derivatives thereof, relate to the orientation of the elements shown in the drawings and are not limiting upon the claims unless expressly recited therein.

As employed herein, the term "number" shall mean one or an integer greater than one (i.e., a plurality).

As employed herein, the term "fastener" refers to any suitable connecting or tightening mechanism expressly including, but not limited to, rivets, screws, bolts and the combinations of bolts and nuts (e.g., without limitation, lock nuts) and bolts, washers and nuts.

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

Figure 2:
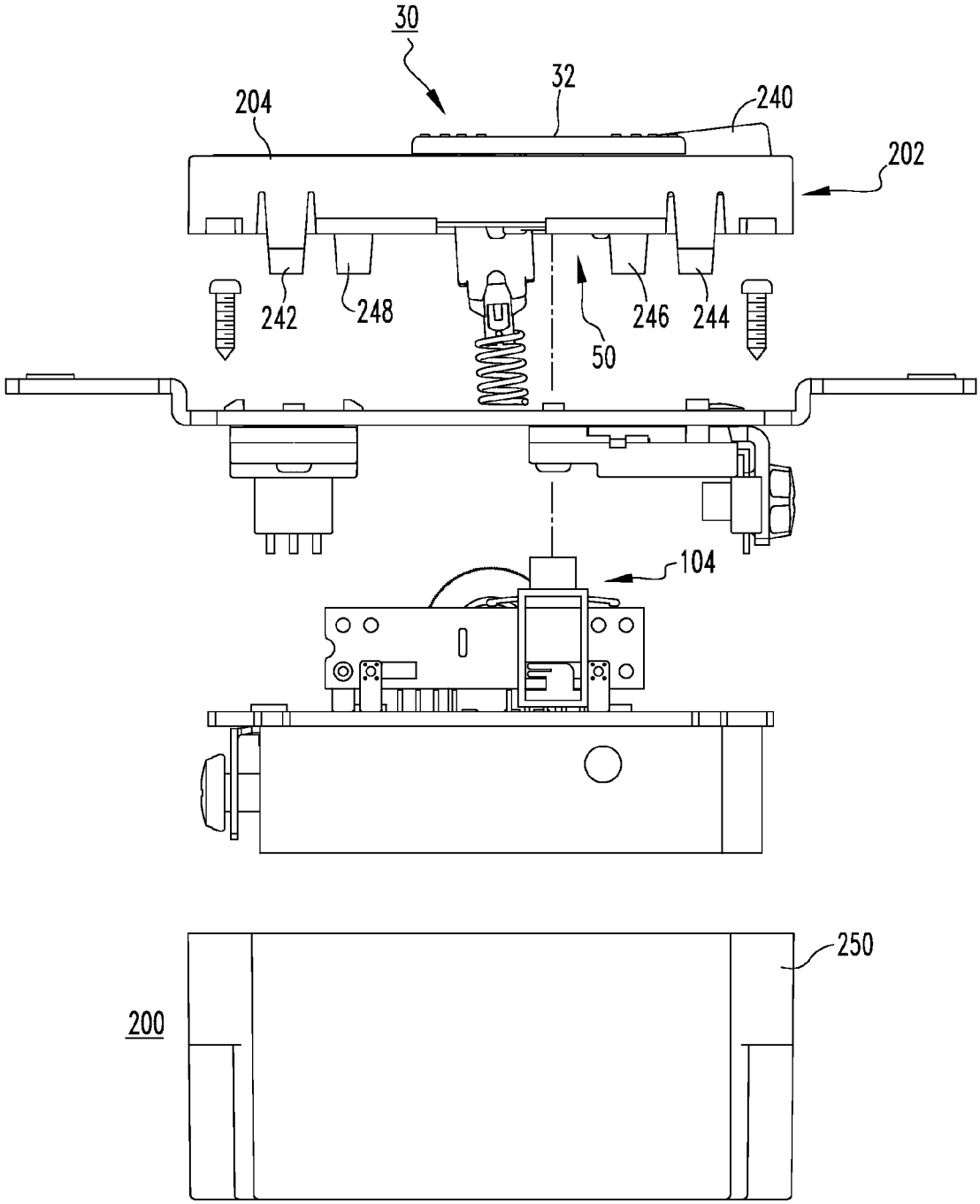
FIG. 2 is an exploded elevation view of the dimmer switch and slider assembly therefor of FIG. 1.

FIGS. 1 and 2 show one non-limiting example of an electrical switch 200 (e.g., without limitation, dimmer switch) employing a slider assembly 30 in accordance with the disclosed concept. The electrical switch 200 generally includes a switching member (see, for example and without limitation, potentiometer generally indicated by reference 104 in FIG. 2), and a housing member 202. In the example shown and described herein, the housing member 202 is a removable cover including a plurality of resilient tabs 242, 244,246,248 (four are shown) for removably securing the removable cover 202 to a corresponding metal strap. The assembly may also be optionally employed in cooperation with an enclosure, such as the example electrical box 250, shown. It will be appreciated, however, that the housing member (e.g., 202) could have any known or suitable alternative configuration (not shown) and/or could be coupled to the electrical box 250 or other structure (not shown) in any known or suitable alternative manner (not shown), without departing from the scope of the disclosed concept. The housing member or removable cover 202 includes an exterior 204, an interior surface 208 (best shown in the section view of FIG. 5), and an elongated slot 230 (best shown in FIG. 3).

Figure 3:
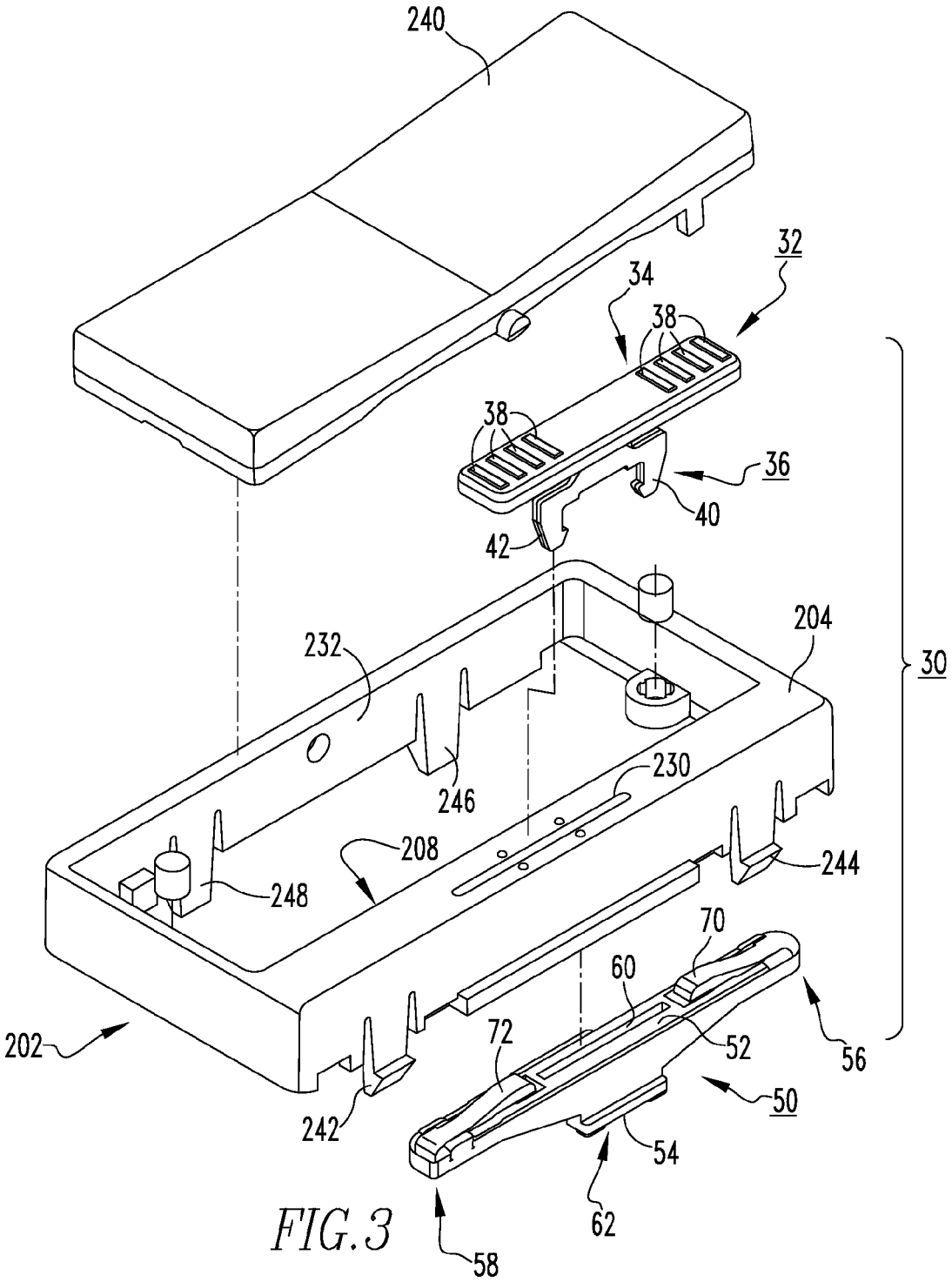
FIG. 3 is an exploded isometric view of the slider assembly of FIG. 2.
Figure 4:
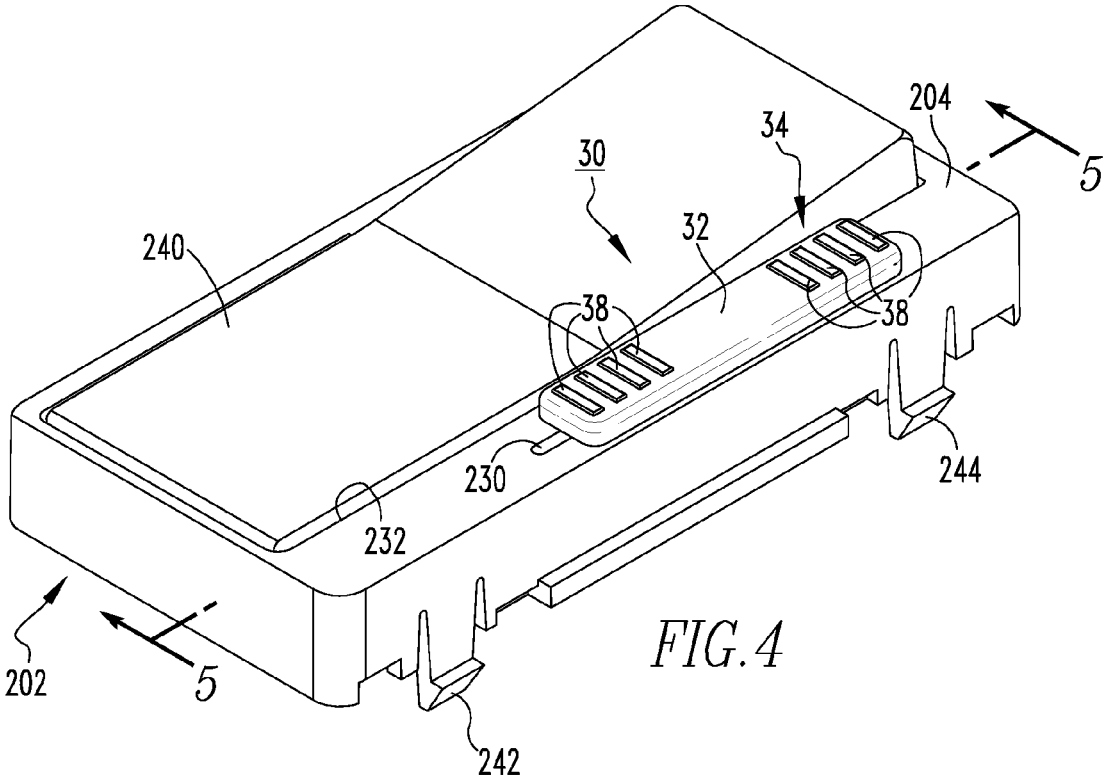
FIG. 4 is an assembled isometric view of the slider assembly of FIG. 3.
Figure 5:
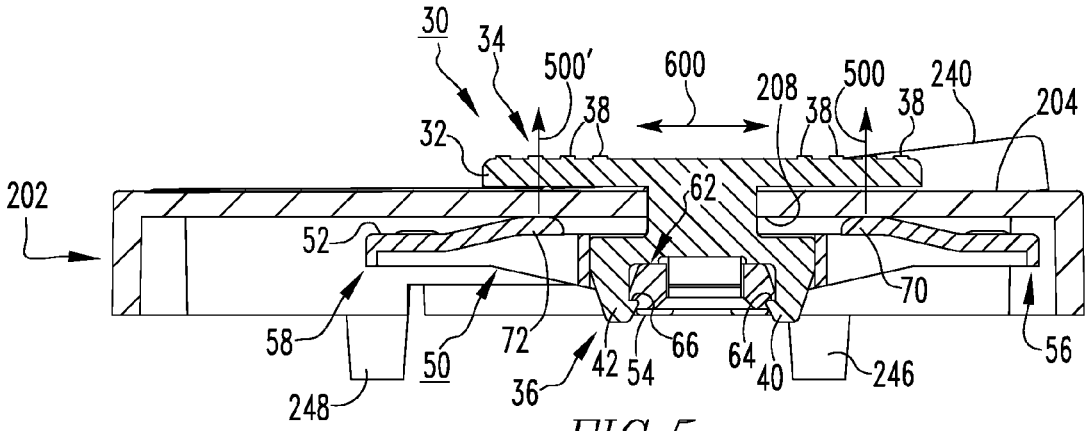
FIG. 5 is a section view taken along line 5-5 of FIG. 4.
Figure 6:
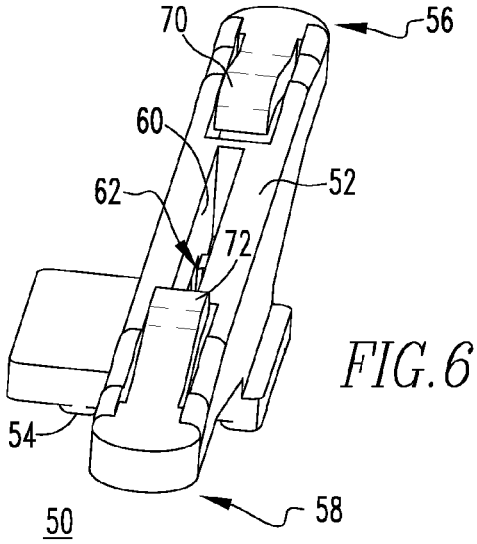
FIG. 6 is an isometric view of the shutter member of the slider assembly of FIG. 5.
Figure 7A:
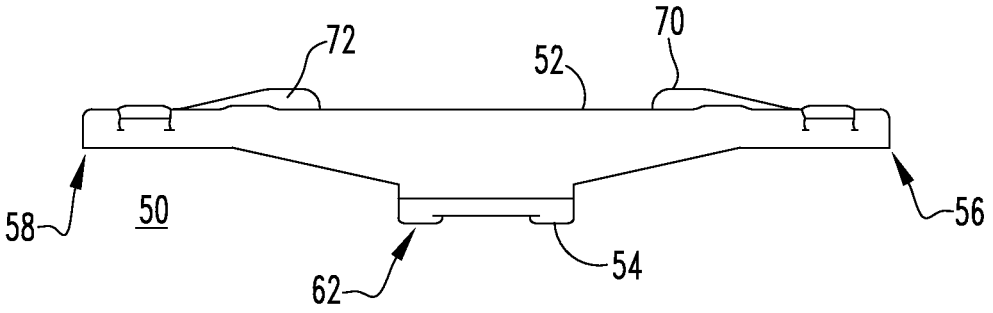
FIGS. 7A, 7B and 7C are side elevation, top plan and bottom plan views, respectively, of the shutter member of FIG. 6.
Figure 7B:
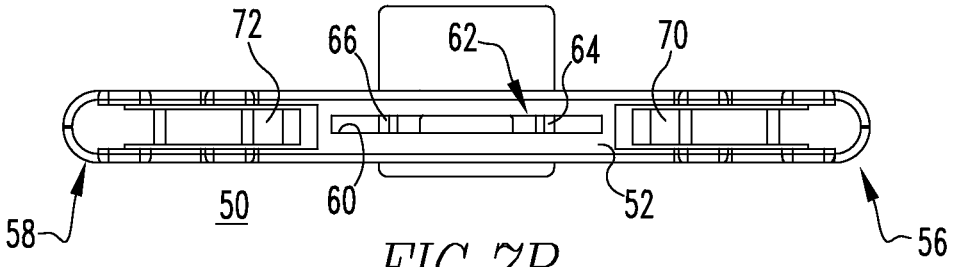
Figure 7C:
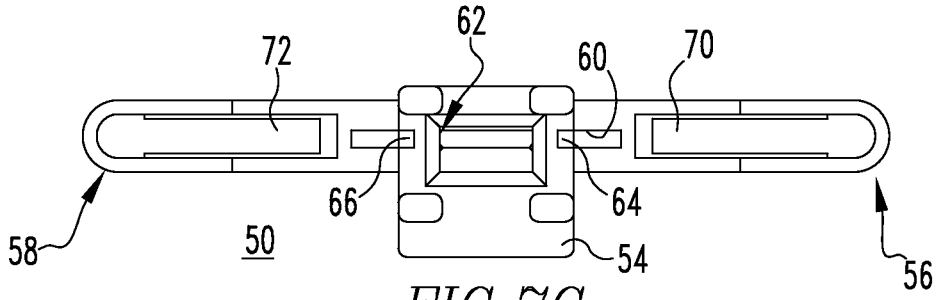

FIGS. 3, 4 and 5 provide exploded, assembled, and section views, respectively, of the slider assembly 30. Among other benefits, the disclosed slider assembly 30 provides improved ergonomics and operating characteristics. For example and without limitation, the slider assembly 30, in accordance with the disclosed concept, provides smooth and effective slider movement due to a positive reaction force and good friction force, without relying on interference play between various slider assembly components. Thus, the disclosed slider assembly 30 has a desirable enhanced overall "feel" as compared to prior art slider assemblies.

In the example shown and described herein, the slider assembly 30 includes a slider 32, which is structured to cooperate with the potentiometer 104 (FIG. 2). The slider 32 includes an interface portion 34 and an attachment portion 36. The attachment portion 36 is structured to extend through the elongated slot 230 of the housing member 202. As shown, the interface portion 34 comprises an elongated molded portion structured to be movably disposed on the exterior surface 204 of the housing member 202. To provide enhanced ergonomics and general "feel" (e.g., without limitation, improved grip by a user's finger) the interface portion 34 of the example slider 32 preferably includes a plurality of ribs or serrations 38.

Continuing to refer to FIG. 3, and also to FIGS. 5-7C, the slider assembly 30 further includes a shutter 50, which is coupled to the slider 32. The shutter 50 includes a plurality of resilient elements 70,72 (two are shown), which are structured to engage the interior surface 208 of the housing member 202, as shown in FIG. 5, thereby creating a desirable friction force associated with movement of the slider 32. It is this interaction, which is afforded by the exemplary shutter 50, which provides the aforementioned improved smooth slider operation and positive reaction force for the user. In the example shown and described herein, both the slider 32 and shutter 50 are single-piece molded members, and the slider 32 is preferably removably coupled to the shutter 50.

The shutter 50 generally includes first and second opposing sides 52,54, first and second opposing ends 56,58, and an elongated slot 60. The elongated slot 60 is disposed between the first end 56 and the second end 58, and extends from the first side 52 toward the second side 54, as best shown in FIGS. 3, 6, 7B and 7C. As shown, for example, in FIG. 3, the elongated slot 60 of the shutter 50 is generally aligned with the elongated slot 230 of the housing member 202.

Referring again to FIGS. 3 and 5, the attachment portion 36 of the example slider 32 includes a first resilient prong 40 extending outwardly from the interface portion 34, and a second resilient prong 42 extending outwardly from the interface portion 34 opposite and spaced from the first resilient prong 40. The first and second resilient prongs 40,42, are structured to removably engage a mounting portion 62 of the shutter 50. More specifically, as best shown in the section view of FIG. 5, the shutter mounting portion 62 includes a first edge 64 and a second edge 66. The first and second resilient prongs 40,42 extend through the elongated slot 230 of the housing member 202 and through the elongated slot 60 of the shutter 50. The first resilient prong 40 removably engages the first edge 64 of the mounting portion 62, and the second resilient prong 42 removably engages the second edge 66 of the mounting portion 62, as shown.

As previously discussed, the shutter includes a plurality of resilient elements 70,72 for engaging the interior surface 208 of the housing member 202 and providing a desired friction force and, in turn, creating the desired smooth movement of the slider 32. In the example shown and described herein, the resilient elements comprise a first molded spring element 70 extending outwardly from the first side 52 of the shutter 50, and a second molded spring element 72 extending outwardly from the first side 52 of the shutter 50 opposite and spaced from the first molded spring element 70 (see, for example, FIGS. 3, 5, 6 and 7A-7C). More specifically, the first molded spring element 70 is disposed between the first end 56 of the shutter 50 and the elongated slot 60 of the shutter 50. The second molded spring element 72 is disposed between the second end 58 of the shutter 50 and the elongated slot 60 of the shutter 50. It is the molded spring elements 70,72, which are structured to be compressed against the interior surface 208 of the housing member 202. That is, the first and second molded spring elements 70 and 72 each respectively exert a bias against the interior surface 208 of the housing member 202 in the direction of arrows 500 and 500' of FIG. 5. In this manner, the necessary friction force and positive user feedback is created to provide smooth movement (e.g., sliding left and right in the direction of arrow 600 from the perspective of FIG. 5) of the slider 32.

It will be appreciated that the disclosed slider assembly 300 could be employed independently or in combination with any known or suitable alternative electrical switch (not shown) other than, or in addition to, the dimmer switch 200 shown and described herein. For example and without limitation, dimmer switch 200 further includes a toggle 240 movably (e.g., pivotably) disposed within an opening 232 of the housing member 202. The slider assembly 30 and, in particular slider 32, is disposed adjacent to the toggle 240 (see, for example, FIGS. 1, 3 and 4). It will be appreciated, however, that any known or suitable alternative slider assembly arrangement or configuration (not shown) could be employed, without departing from the scope of the disclosed concept.

Accordingly, the disclosed slider assembly 30 provides an effective mechanism for establishing enhanced ergonomics and improved slider operation and overall "feel" to the user.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. A slider assembly for an electrical switch, said electrical switch including a switching member and a housing member overlaying said switching member, said housing member comprising an exterior surface, an interior surface, and an elongated slot, said slider assembly comprising:

a slider structured to cooperate with said switching member, said slider including an interface portion and an attachment portion, said attachment portion being structured to extend through said elongated slot of said housing member, said interface portion being structured to be movably disposed on the exterior surface of said housing member; and a shutter coupled to said slider, said shutter including a first resilient element and a second resilient element each structured to engage the interior surface of said housing member, thereby creating a friction force associated with movement of said slider, said shutter being separate and distinct from said slider, wherein said slider is a single-piece molded member, wherein said shutter is a single-piece molded member, wherein said slider is removably coupled to said shutter, wherein said shutter further includes a first end and a second end disposed opposite and distal the first end, the first end and the second end being disposed on an axis parallel to said interface portion, wherein said first resilient element extends from the first end toward said second resilient element and said interface portion, and wherein said second resilient element extends from the second end toward said first resilient element and said interface portion.

2. The slider assembly of claim 1 wherein said interface portion of said slider comprises an elongated molded portion; and wherein said elongated molded portion includes a plurality of ribs or serrations.

3. The slider assembly of claim 1 wherein said shutter comprises a first side, a second side disposed opposite the first side, and an elongated slot disposed between the first end and the second end and extending from the first side toward the second side; and wherein the elongated slot of said shutter is structured to substantially align with the elongated slot of said housing member.

4. The slider assembly of claim 3 wherein said attachment portion of said slider comprises a first resilient prong extending outwardly from said interface portion and a second resilient prong extending outwardly from said interface portion opposite and spaced from said first resilient prong.

5. The slider assembly of claim 4 wherein said shutter further comprises a mounting portion disposed on the second side; and wherein said first resilient prong and said second resilient prong are structured to extend through the elongated slot of said housing member and through the elongated slot of said shutter to removably engage said mounting portion of said shutter.

6. The slider assembly of claim 5 wherein said mounting portion includes a first edge and a second edge; wherein said first resilient prong removably engages the first edge; and wherein said second resilient prong removably engages the second edge.

7. The slider assembly of claim 3 wherein said first resilient element is a first molded spring element extending outwardly from the first side; and wherein said second resilient element is a second molded spring element extending outwardly from the first side opposite and spaced from the first molded spring element.

8. The slider assembly of claim 7 wherein said first molded spring element is disposed between the first end and the elongated slot of said shutter; and wherein said second molded spring element is disposed between the second end and the elongated slot of said shutter.

9. The slider assembly of claim 8 wherein said first molded spring element and said second molded spring element are structured to exert a bias against the interior surface of said housing member to create said friction force associated with movement of said slider.

10. An electrical switch comprising:

a switching member;

a housing member overlaying said switching member, said housing member comprising an exterior surface, an interior surface, and an elongated slot; and a slider assembly comprising:

a slider cooperating with said switching member, said slider including an interface portion and an attachment portion, said attachment portion extending through said elongated slot of said housing member, said interface portion being movably disposed on the exterior surface of said housing member, and a shutter coupled to said slider, said shutter including a first resilient element and a second resilient element each engaging the interior surface of said housing member to create a friction force associated with movement of said slider, said shutter being separate and distinct from said slider, wherein said slider is a single-piece molded member, wherein said shutter is a single-piece molded member, wherein said shutter further includes a first end and a second end disposed opposite and distal the first end, the first end and the second end being disposed on an axis parallel to said interface portion, wherein said first resilient element extends from the first end toward said second resilient element and said interface portion, and wherein said second resilient element extends from the second end toward said first resilient element and said interface portion.

11. The electrical switch of claim 10 wherein said interface portion of said slider comprises an elongated molded portion; and wherein said elongated molded portion includes a plurality of ribs or serrations.

12. The electrical switch of claim 10 wherein said electrical switch is a dimmer switch; wherein said housing member is a removable cover; wherein said removable cover further includes a central toggle; and wherein said slider is disposed adjacent to said toggle.

13. The electrical switch of claim 10 wherein said shutter comprises a first side, a second side disposed opposite the first side, and an elongated slot disposed between the first end and the second end and extending from the first side toward the second side; and wherein the elongated slot of said shutter is substantially aligned with the elongated slot of said housing member.

14. The electrical switch of claim 13 wherein said attachment portion of said slider comprises a first resilient prong extending outwardly from said interface portion and a second resilient prong extending outwardly from said interface portion opposite and spaced from said first resilient prong.

15. The electrical switch of claim 14 wherein said shutter further comprises a mounting portion disposed on the second side; and wherein said first resilient prong and said second resilient prong extend through the elongated slot of said housing member and through the elongated slot of said shutter to removably engage said mounting portion of said shutter.

16. The electrical switch of claim 15 wherein said mounting portion includes a first edge and a second edge; wherein said first resilient prong removably engages the first edge; and wherein said second resilient prong removably engages the second edge.

17. The electrical switch of claim 13 wherein said first resilient element is a first molded spring element extending outwardly from the first side; and wherein said second resilient element is a second molded spring element extending outwardly from the first side opposite and spaced from the first molded spring element.

18. The electrical switch of claim 17 wherein said first molded spring element is disposed between the first end and the elongated slot of said shutter; and wherein said second molded spring element is disposed between the second end and the elongated slot of said shutter.

19. The electrical switch of claim 18 wherein said first molded spring element and said second molded spring element exert a bias against the interior surface of said housing member to create said friction force associated with movement of said slider.

20. A slider assembly for an electrical switch, said electrical switch including a switching member and a housing member overlaying said switching member, said housing member comprising an exterior surface, an interior surface, and an elongated slot, said slider assembly comprising:

a slider structured to cooperate with said switching member, said slider including an interface portion and an attachment portion, said attachment portion being structured to extend through said elongated slot of said housing member, said interface portion being structured to be movably disposed on the exterior surface of said housing member; and a shutter coupled to said slider, said shutter including a first resilient element and a second resilient element each structured to engage the interior surface of said housing member, thereby creating a friction force associated with movement of said slider, wherein the friction force is exerted against the interior surface of said housing member in a direction toward said interface portion of said slider, wherein said shutter further includes a first end and a second end disposed opposite and distal the first end, the first end and the second end being disposed on an axis parallel to said interface portion, wherein said first resilient element extends from the first end toward said second resilient element and said interface portion, and wherein said second resilient element extends from the second end toward said first resilient element and said interface portion.

* * * * *